United States Patent [19]

McIntosh, Sr.

[11] 3,991,871

[45] Nov. 16, 1976

[54] PRINT HEAD AND PLASTIC BEARINGS THEREFOR

[75] Inventor: Robert A. McIntosh, Sr., Nashua, N.H.

[73] Assignee: Centronics Data Computer Corporation, Hudson, N.H.

[22] Filed: Sept. 10, 1974

[21] Appl. No.: 504,711

[52] U.S. Cl. ..... 197/1 R; 308/3.9

[51] Int. Cl.[2] ..... B41J 3/04

[58] Field of Search ..... 197/1 R; 308/1 R, 3.9, 308/3 R; 101/93.04, 93.05

[56] References Cited

UNITED STATES PATENTS

| | | | |
|---|---|---|---|
| 2,785,627 | 3/1957 | Johnson | 197/1 R X |
| 3,198,306 | 8/1965 | Bachman | 197/1 R |
| 3,302,562 | 2/1967 | Nelson | 197/1 R X |
| 3,584,575 | 6/1971 | Distl | 197/1 R X |
| 3,690,431 | 9/1972 | Howard | 197/1 R |
| 3,802,543 | 4/1974 | Howard | 197/1 R |
| 3,820,643 | 6/1974 | Priebs et al. | 197/1 R |
| 3,835,975 | 9/1974 | Howard | 197/1 R |

*Primary Examiner*—Ralph T. Rader

[57] ABSTRACT

A print head for impact printers of the dot matrix type comprising a hollow die cast housing having solenoids mounted upon a rear wall thereof and having print wires driven thereby and extending through the rear wall and hollow housing toward the forward end. A plastic bearing is releasably mounted in the forward wall and serves as a low friction bearing for the reciprocating print wires and to prevent abrasive wear of the print wires when in the retracted position. The guide means mounted within the housing and intermediate the forward and rearward ends thereof support guide tubes for maintaining relative positioning of the print wires as well as maintaining their desired natural curvature.

The plastic bearing is formed of a plastic material for significantly increasing operating life and which is compliant to attenuate a significant amount of side loading due to impact. The plastic bearings are admixed with additives to make the bearings self lubricating.

The plastic bearings are arranged to be readily removed and replaced.

17 Claims, 28 Drawing Figures

FIG. 1a.
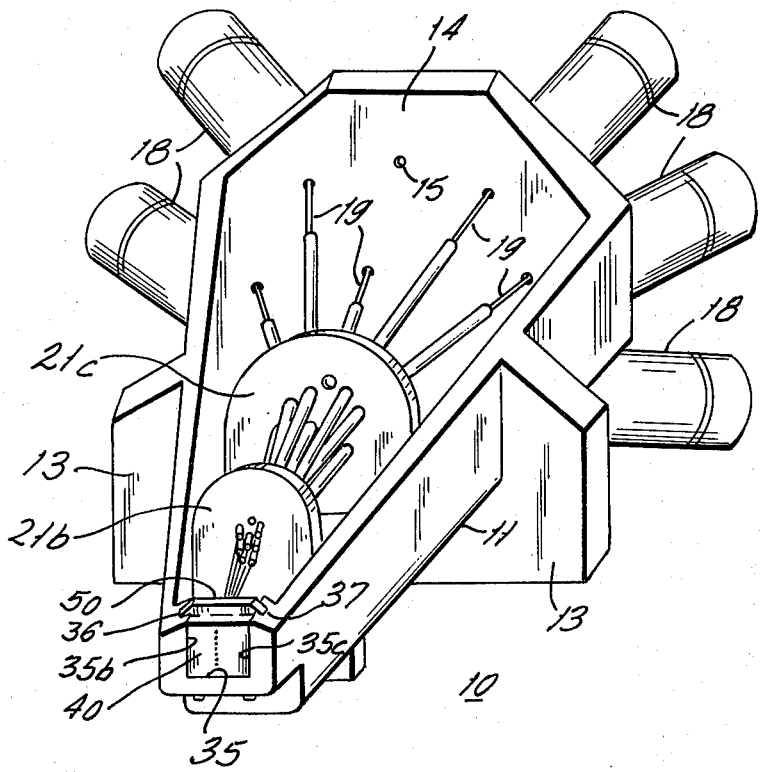
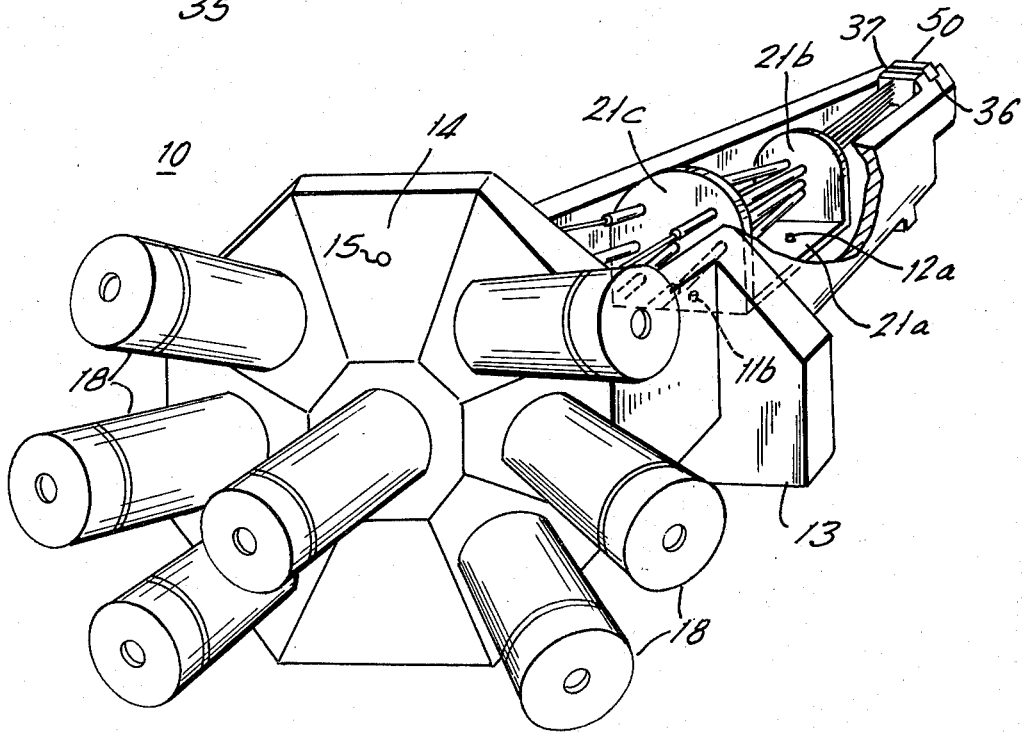
FIG. 1b.

FIG. 3a.
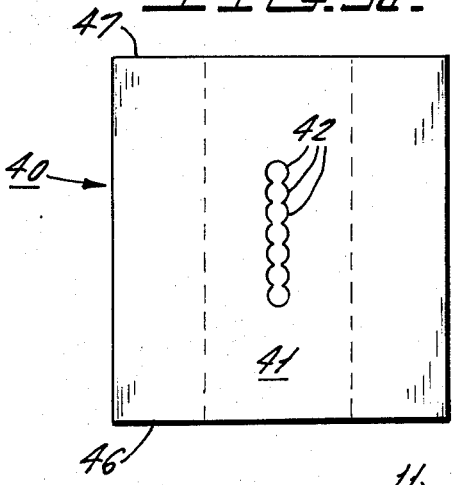
FIG. 3b.
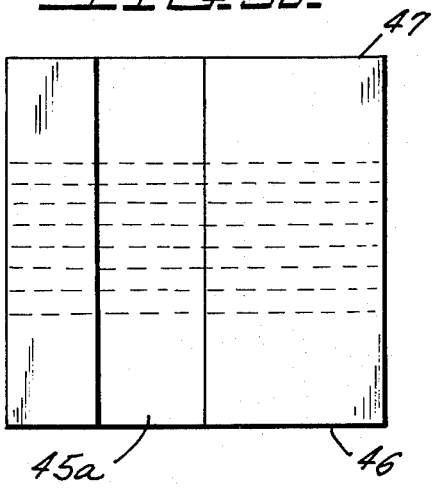
FIG. 1e.
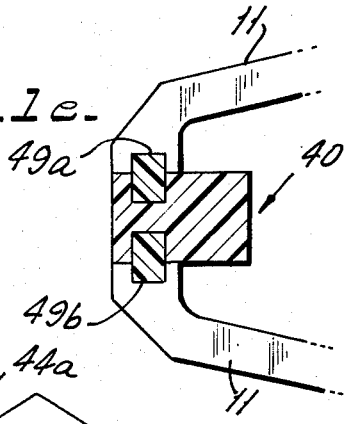
FIG. 3c.
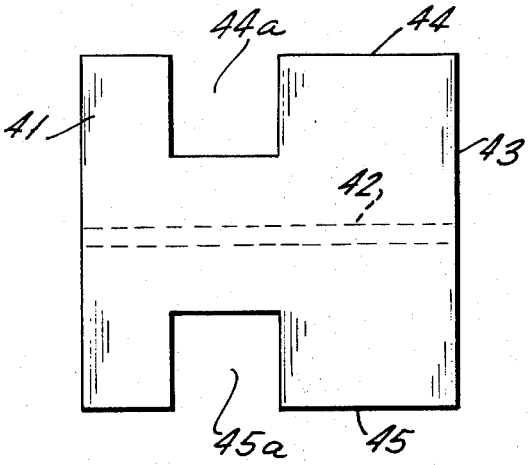
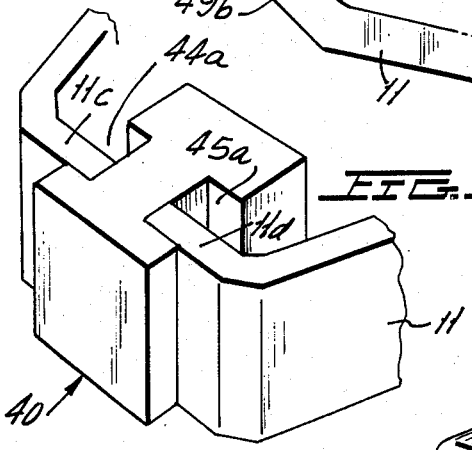
FIG. 1d.
FIG. 1g.
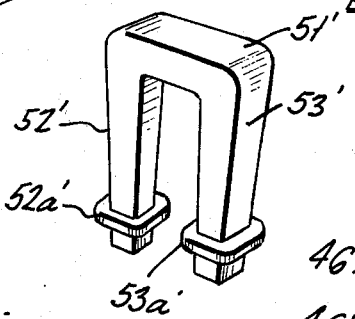
FIG. 1h.
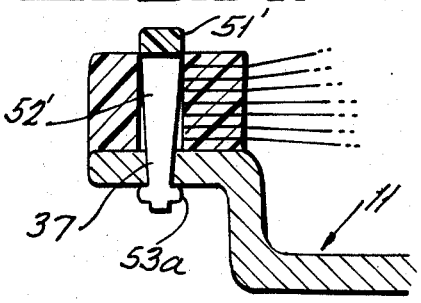
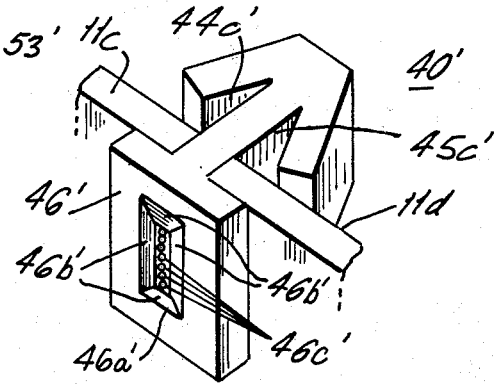
FIG. 1f.

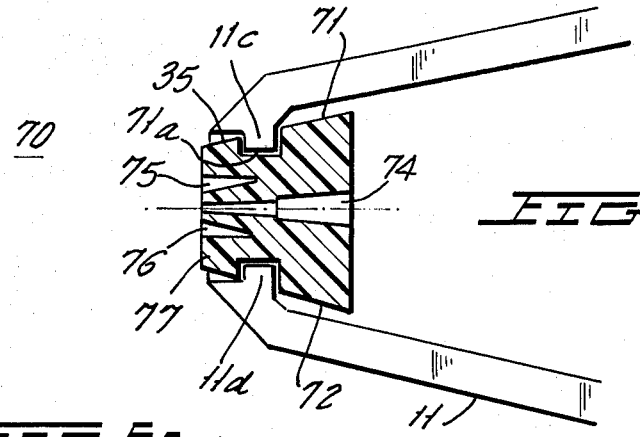
FIG. 6a.
FIG. 6c.
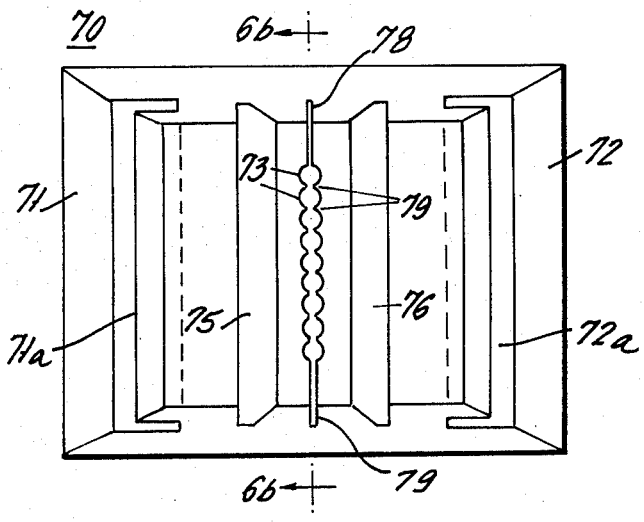
FIG. 6b.
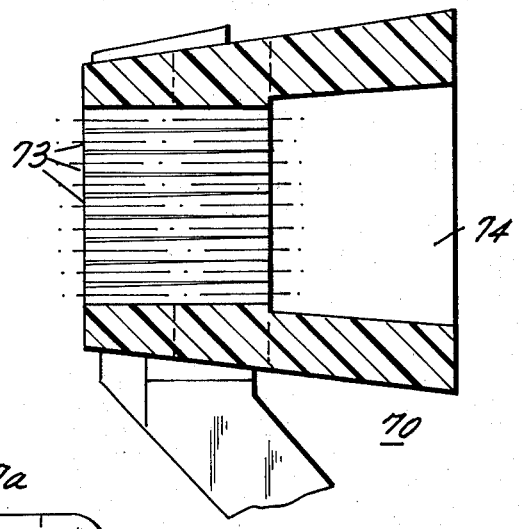
FIG. 8.
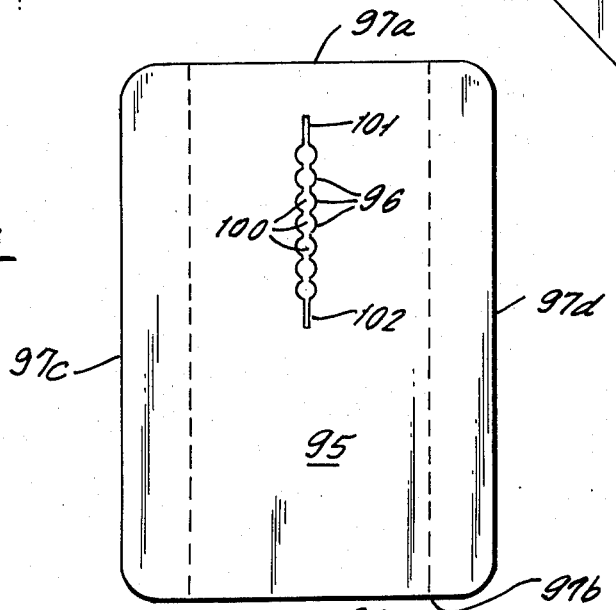
FIG. 8a.
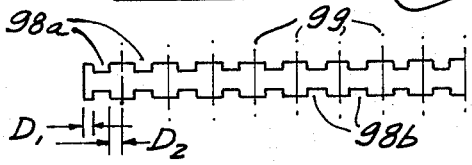

PRINT HEAD AND PLASTIC BEARINGS THEREFOR

BACKGROUND OF THE INVENTION

The present invention relates to printers and more particularly to a novel print head for impact printers of the dot matrix type utilizing novel replaceable plastic bearings.

Dot matrix printers are typically comprised of a plurality of linearly aligned solenoid driven print wires. The print head is moved across a paper document and selected ones of the solenoids are energized to drive their associated print wires against an inked ribbon to form dot column patterns at closely spaced intervals along the line of print. In one typical embodiment, the print head comprises seven print wires and five dot columns are utilized to collectively form a single character whereby each character is formed within a 5 × 7 dot matrix. Selective energization of the solenoids permits the generation of alphabetic and numeric characters, punctuation symbols and the like.

Assuming a 132 column printer, i.e., a printer capable of printing 132 characters per line of print with each character formed within a 5 × 7 dot matrix, so that five dot columns are utilized for each character, each individual solenoid may be caused to function 660 times per printed line. In the formation of graphic patterns, each solenoid may be caused to operate 792 times per line of print.

The print wires are typically spaced about 0.006 inches from the inked ribbon and paper document. The total distance to the platen is approximately 0.015 inches. The forward ends of the print wires are spaced from the paper document less than 0.015 inches to allow the platen, paper document and ribbon to absorb some of the impact.

Present day printers are capable of printing at the rate of 330 characters per second and 125 lines per minute (for lines of 132 character length). In order to achieve these print speeds, the print wires must be capable of being accelerated from a rest position to a velocity sufficient to form a dot on the paper and return to its rest position in less than one millisecond. Acceleration rates on both impact and retraction and the impact forces occurring during dot printing impart continuous and significant sidewise forces upon the bearing which causes the conventional jewel bearings typically formed of ruby or sapphire to fracture and chip due to side loading forces thus shortening the life of the jewel and hence the print head structure. Also the present design makes the head substantially useless once the bearings are damaged or broken.

BRIEF DESCRIPTION OF THE INVENTION

The present invention is characterized by providing a novel print head assembly having a compliant self-lubricating plastic bearing member which is further designed to facilitate removal and replacement thereof.

The print head comprises a hollow die cast member having a rearward mounting surface for securing the print wire solenoids whose print wires extend through the hollow interior toward the front end of the substantially conical-shaped housing. The forward end of the housing is provided with a pair of guide slots for receiving a plastic bearing which may be either force-fitted into the guide slots or, alternatively, may be locked into position by means of a substantially U-shaped compliant brad which greatly simplifies both assembly and disassembly thereof.

The plastic bearing is formed of a novel compliant self-lubricated plastic material which provides an excellent low friction bearing for the reciprocating print wires, absorbs a significant amount of the side load forces imparted thereto and which is further characterized by its ability to resist undue wearing even after long continuous operation.

A novel guide assembly is employed within the hollow interior for positioning and supporting guide tubes which serve to retain the natural curvature of the reciprocating print wires.

BRIEF DESCRIPTION OF THE FIGURES AND OBJECTS

It is therefore one object of the present invention to provide a novel print head assembly for use in dot matrix print head assemblies which employ novel plastic bearings.

Another object of the present invention is to provide a print head design for dot matrix printers and the like in which novel plastic bearings are provided with the design thereof being adapted to significantly facilitate ease of assembly and disassembly.

The above as well as other objects of the present invention will become apparent when reading the accompanying description and drawings in which:

FIGS. 1*a* and 1*b* are front and rear perspective views respectively, of a print head embodying the principles of the present invention.

FIG. 1*c* is a sectional elevational view of the print head of FIGS. 1*a* and 1*b*.

FIGS. 1*d*, 1*f* and 1*h* are perspective views of alternative embodiments of the plastic bearing of FIGS. 1*a* and 1*b*.

FIG. 1*e* is a top plan view of still another embodiment of the plastic bearing.

FIG. 1*g* is a perspective view of the brad employed in the embodiment of FIG. 1*h*.

FIG. 2*a* is a top plan view showing the nose portion of the print head housing in view 1*a*.

FIG. 2*b* shows a sectional view of the nose portion taken along the line 2*b*—2*b* of FIG. 2*a*.

FIG. 2*c* shows an exploded perspective view of the bearing mounting assembly for the print head of FIG. 1*a*.

FIGS. 3*a*, 3*b* and 3*c* are front elevation, side elevation and top plan views respectively, of the plastic bearing of FIGS. 1*c* and 1*b*.

FIG. 4*a* is a sectional view of still another embodiment of the plastic bearing.

FIG. 4*b* is a front elevational view of the embodiment of FIG. 4*a*.

FIGS. 5*a* and 5*b* are front elevation and top plan views respectively of another embodiment of the plastic bearing.

FIGS. 5*c* and 5*d* are a side elevational view on one jewel half of FIG. 5*b* looking in the direction of arrows 5*c*—5*c* and 5*d*—5*d*, respectively.

FIGS. 6*a*, 6*b* and 6*c* are top plan, front elevational and sectional views of still another embodiment of the plastic bearing.

FIGS. 7*a*, 7*b* and 7*c* are top plan, side and front elevational views of still another embodiment of the plastic bearing.

FIG. 8 is a front elevational view of still another embodiment of the plastic bearing.

FIG. 8*a* is a top plan view of the bearing of FIG. 8.

DETAILED DESCRIPTION OF THE INVENTION

Figure 1C:
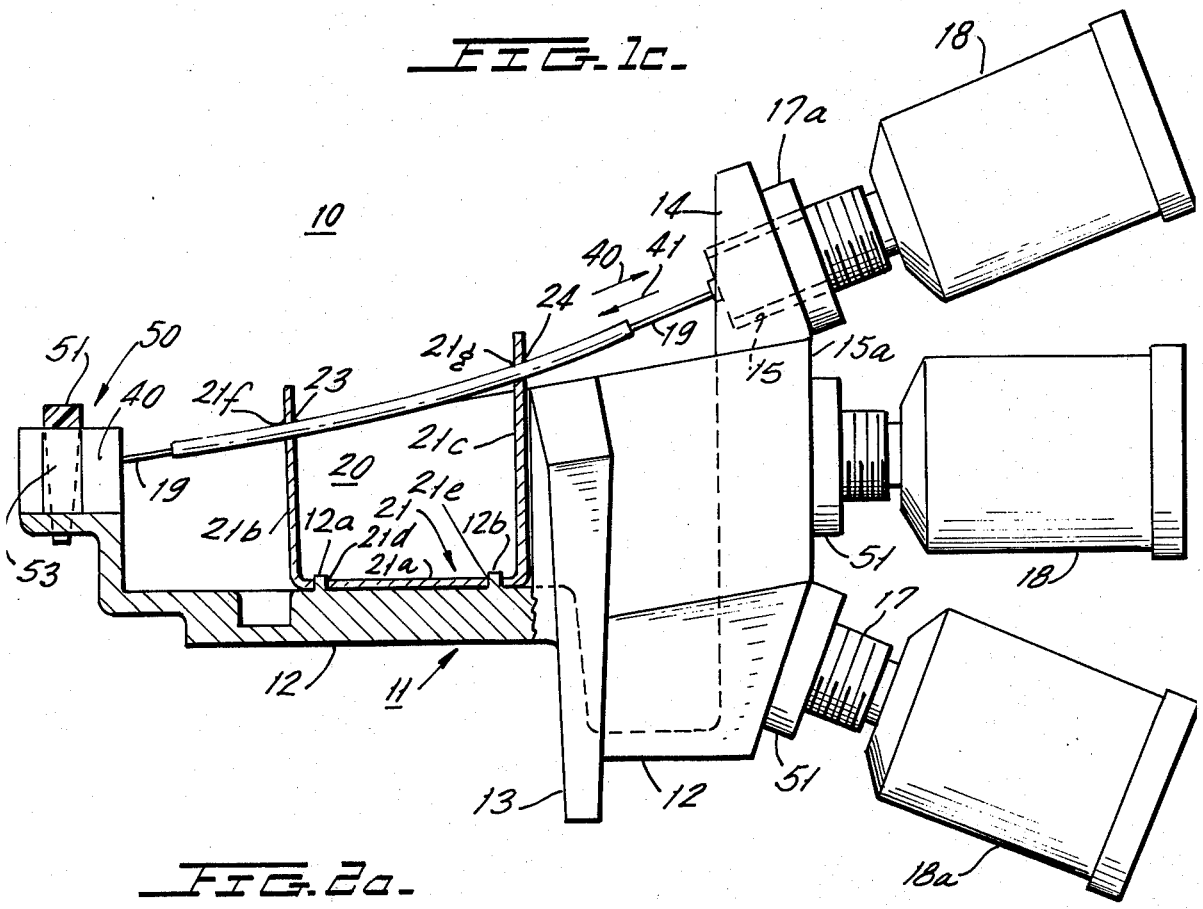

FIGS. 1*a*–1*c* show a print head assembly 10 comprised of a one-piece die cast member 11 having a base portion 12 provided with outwardly extending flanges 13 for mounting member 11 on a movable carriage (not shown).

The rear surface of member 11 is provided with an upwardly projecting wall 14 having a plurality of tapped apertures 15. The rearwardly directed surface of wall 14 has a truncated pyramidal configuration and the openings 15 extending through rear wall 14 to rear surface 15*a* are aligned so as to be substantially perpendicular to their associated mounting surfaces. All of the tapped openings 15 are aligned so that their imaginary central axes will intersect at a remote point forward of rear wall 14.

The tapped openings 15 each threadedly engage the threaded stem 17 of a solenoid assembly 18, each solenoid having a slender print wire 19 projecting outwardly through the forward opening of each solenoid assembly and extending into and through the hollow interior of member 11.

An intermediate guide assembly 20 is mounted within member 11 and is comprised of a flat one-piece metallic stamping 21 bent in a substantially U-shaped configuration and having a base portion 21*a* and upwardly extending tube guide mounting arms 21*b* and 21*c*. Base portion 21*a* is provided with openings 21*d* and 21*e* for receiving associated projections 12*a* and 12*b* extending upwardly from the interior floor 12 of member 11. The projections extend through openings 21*d* and 21*e* and after mounting thereon are peened or otherwise flattened to secure the guide plate 21 to member 11. Each of the guide arms 21*b* and 21*c* is provided with a plurality of apertures for receiving curved hollow guide tubes 22 each being affixed to an associated opening such as, for example, the openings 21*f* and 21*g* in guide arms 21*b* and 21*c*, respectively. The guide tubes are permanently affixed thereto by a suitable epoxy as shown, for example, at 23 and 24.

The print wires 19 each extend through an associated one of the curved guide tubes 22 and through a centrally located opening 35 in the forward wall 34 of member 11. Tubes 22 serve to maintain the natural curvature of the print wires 19.

A plastic bearing 40 is fitted into slot 35 and is firmly secured therein by means of a compliant plastic brad 50, as will be more fully described.

Figure 2A:
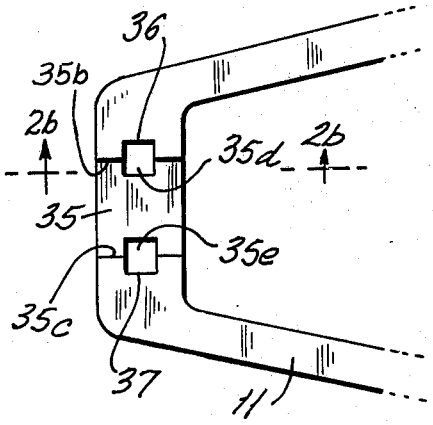
Figure 2C:
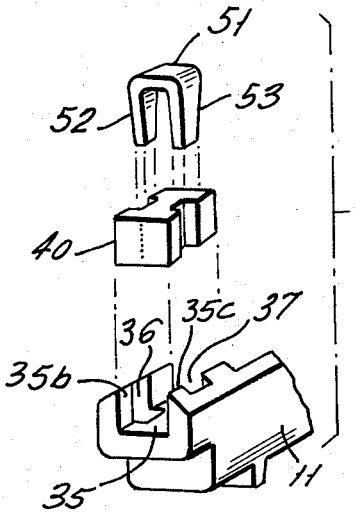
Figure 2B:
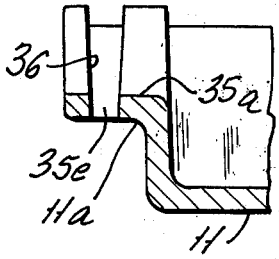
Figure 5C:
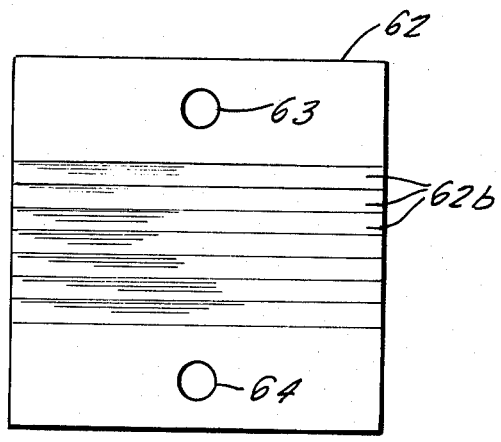
Figure 5A:
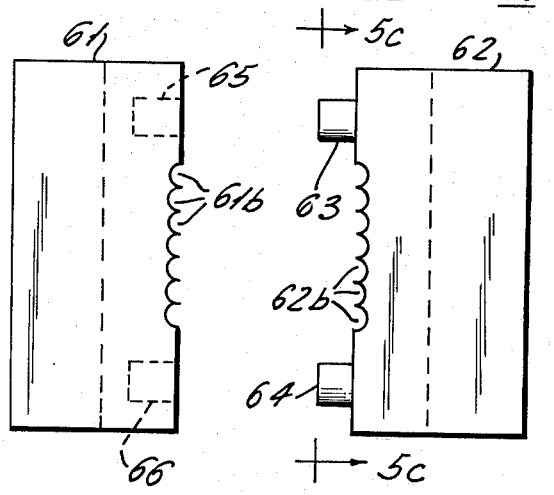

FIGS. 3*a*, 3*b* and 3*c* show front and side elevation and top plan views, respectively, of plastic bearing 40 which has a front face 41 provided with print wire openings 42 extending along the center line of the plastic member to the rear surface 43. The vertical sides 44 and 45 are each provided with notches 44*a* and 45*a* for a purpose to be more fully described. FIGS. 2*a*–2*c* show the manner in which the plastic bearing 40 and brad 50 are assembled into front wall 34. FIG. 2*a* shows a top view of the forward end of member 11 wherein opening 35 is provided with a base portion 35*a* and upright side walls 35*b* and 35*c*. Substantially rectangular-shaped holes 35*d* and 35*e* extend from the underside of member 11 (note especially FIG. 2*b*) and are respectively aligned with slots 36 and 37 provided in side walls 35*b* and 35*c*.

The manner of assembly of the plastic bearing is as follows:

Member 40 is inserted within opening 35 so that its underside 46 rests upon the base 35*a* of opening 35 and so that the slots 44*a* and 45*a* in side walls 44 and 45 are aligned with rectangular openings 35*d* and 35*e*.

Compliant U-shaped brad 50 comprised of a yoke portion 51 and downwardly depending tapered arms 52 and 53 is positioned above bearing 40 so that the free ends of arms 52 and 53 enter into the rectangular-shaped openings defined by slots 44*a* and 45*a* in bearing 40 and slots 36 and 37 in opening 35 of member 11. Brad 51 is then pressed downwardly until its free ends protrude beyond the undersurface 11*a* of member 11. At this time the yoke portion 51 of compliant brad 50 rests upon the top surface 47 of bearing 40. U-shaped compliant brad 50 is force-fitted into these openings so as to firmly secure bearing 40 to member 11.

The print wires 19 of solenoids 18 are inserted through the tapped openings in rear wall 14 and are threaded through their associated guide tubes 22 and one of the substantially circular openings 42 in plastic bearing 40. Each of the solenoids are firmly secured to rear wall 14 by threading their threaded portions 17 into tapped apertures 15. Fine adjustment of the solenoid print wires is made after which time locking nuts 17*a* are firmly tightened against rear surface 15*a* to maintain each of the solenoids 18 and their print wires in proper alignment. The preferred arrangement is such that the forward tips of the print wires 19 are flush with the front surface 41 of print wire bearing 40 when the solenoids are deenergized.

The design of the plastic bearing provides for ease of assembly and disassembly. Disassembly may be accomplished by placing the tapered portion of a flat member, such as a knife or screwdriver, beneath the yoke 51 of compliant brad 50 to force it out of engagement with the openings 35*d* and 35*e* and member 11 and out of the openings collectively defined by slots 44*a* and 45*a* in bearing 40 and slots 36 and 37 in opening 35 of member 11. After the compliant brad has been removed, the plastic bearing may be lifted from opening 35 and replaced by a new plastic bearing.

During this operation the print wires may be held near their forward ends with a long nose pliers while plastic bearing 40 is slid out of opening 35. The new plastic bearing is simply slid into opening 35 while print wires are held with the long nose pliers until the forward ends of the print wires are guided into the openings 42. As soon as the new plastic bearing is properly positioned a compliant brad may again be force-fittingly inserted into position.

The print head 10 may be provided with inwardly directed projections 11*c* and 11*d* at the nose of housing 11 as shown in FIG. 1*d*. Brad 50 may be inserted behind the projections 11*c* and 11*d* and within slots 44*a* and 45*a*. If desired brad 50 may be replaced by individual compliant tapered strips or pins 49*a* and 49*b* as shown in FIG. 1*e*.

The rear surface 46' of bearing 40' (FIG. 1*f*) is provided with a rectangular shaped recess 46*a'* having chamfered sidewalls 46*b'* to facilitate entry of the curved wires into the bearing holes 46*c'*. Initial insertion of the print wires is also simplified.

FIG. 1*g* shows an alternative brad 51' in which the legs 52' and 53' are provided with continuous compliant flanges 52*a'* and 53*a'*. The flanges 52*a'* and 53*a'* are press fitted through the openings 36 and 37 in housing 11 and snap into place once they clear the lower ends of the openings as shown in FIG. 1*h*.

Conventional print heads employ jewel bearings of either ruby or sapphire material which are rigid and non-compliant and hence tend to fracture and chip due to the side loading imparted upon the jewel bearing by the print wires. The plastic bearing 40 is formed of a plastic material which has the advantageous characteristic of being compliant to attenuate a significant amount of side loading due to impact of the print wire against a paper document and the platen typically supporting the paper document. Extremely advantageous plastic materials which may be employed for this purpose are thermoplastic acetal resin, polycarbonate, ethyl cellulose thermoplastic, polyvinyltetrafluoroethylene resin, thermoplastic nylon and thermoplastic polyester. These materials have been found to be quite tenacious and do not chip or crack or fray or wear away when rubbed by a rough surface. The above materials are also preferably mixed with additives including dry lubricant, glass, molybdenum disulfide, and the like, which materials provide the plastic bearings with a self lubricating characteristic which is extremely advantageous for use as a print wire bearing due to the high speed repetitive reciprocating action of the print wires within the bearing over extremely long periods of use.

The compliant characteristic of the material also greatly facilitates the ease of assembly and disassembly, whereas materials such as ruby and sapphire being extremely hard and brittle require that they be cemented within the print head housing by means of an epoxy or other suitable material making it highly impractical to remove and reassemble the jewel members, making the print head impractical to repair.

In addition thereto, ruby and sapphire must be machined to produce satisfactory jewel bearings, whereas the compliant plastic bearings of the present invention may be formed by inexpensive molding or extrusion operations.

Figure 4A:
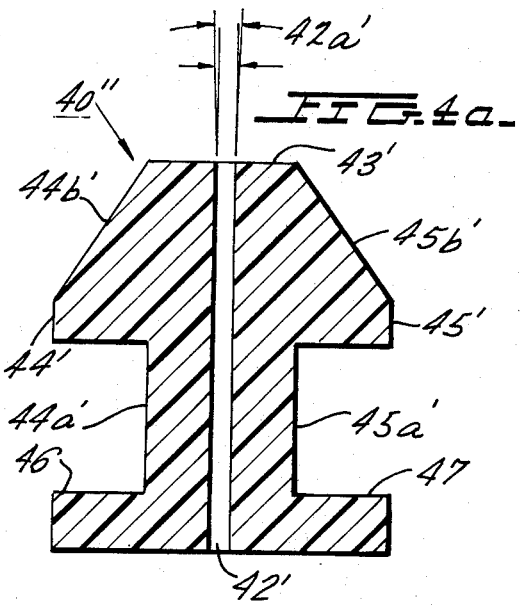
Figure 5B:
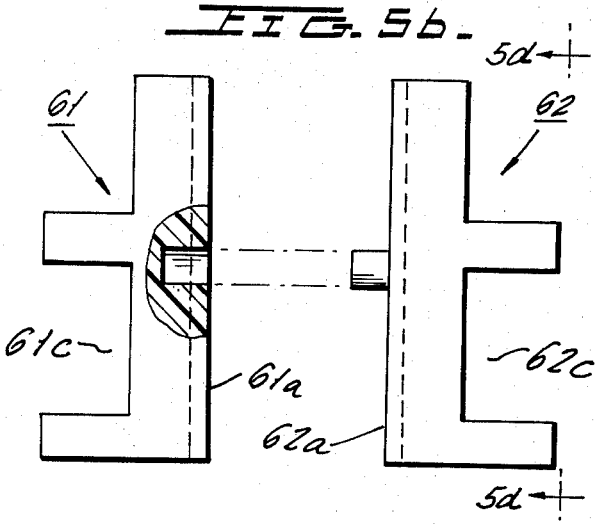
Figure 4B:
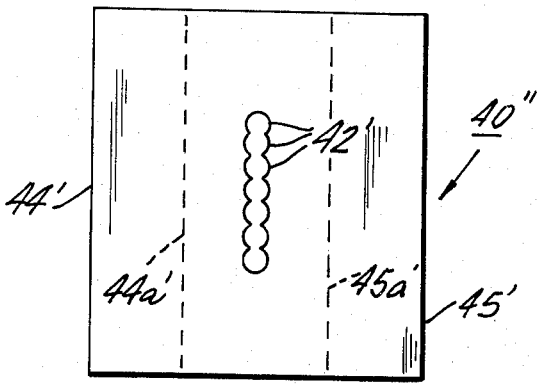
Figure 5D:
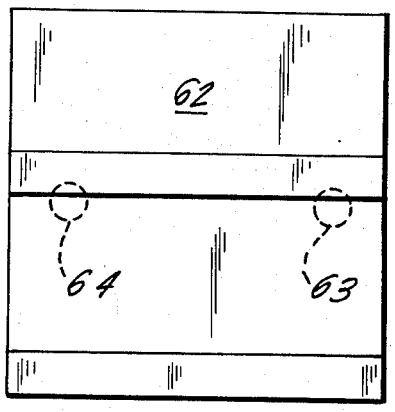

FIGS. 4*a* and 4*b* show another preferred embodiment 40″ of the compliant plastic bearing in which the side walls 44′ and 45′ are tapered toward the rear surface 43′, as shown at 44*b′* and 45*b′*, respectively. The rearward portions of elongated print wire openings 42′ are slightly tapered or widened at their rear ends as shown at 42*a′* to permit the print wires 19 to assume their natural curvature in the region of the rear portion of openings 42′. The tapers 44*b′* and 45*b′* and the rearward portions of side walls 44′ and 45′ serve to increase the compliance at the rearward end of bearing 40″ to further reduce side loading imparted upon the bearing 40″ by the print wires 19. The bearing 40″ may otherwise be mounted upon housing member 11 in the same manner as described hereinabove with regard to bearing 40 and bearing 40″ likewise may be formed of the same materials and hence retain all of the other advantageous features of plastic bearing 40 described hereinabove.

The embodiment 40′ of FIG. 1*f* differs from the embodiment 40″ of FIG. 4 in that the bearing is slotted at 44*c′* and 45*c′* to form a pair of tapered arms which together with the rear surfaces 46 and 47 serve to force-fittingly embrace the inwardly directed projections 11*c* and 11*d* of housing 11. Alternatively, a compliant brad may be inserted into the region defined by housing projections 11*c* and 11*d* and the V-shaped slots 44*c′* and 45*c′*.

FIGS. 5*a*–5*d* show still another preferred embodiment 60 of the plastic bearing member which is a two-piece assembly comprised of bearing halves 61 and 62. The facing vertical sides 61*a* and 62*a* are provided with substantially semicircular-shaped grooves 61*b* and 62*b*, respectively. Mating surface 62*a* of member 62 is provided with a pair of projections 63 and 64 which are arranged to be force-fittingly inserted into openings 65 and 66, respectively, provided in the mating face 61*a* of member 61. Each of the members 61 and 62 are provided with slots 61*c* and 62*c*, respectively, for receiving the compliant U-shaped brad 50 shown, for example, in FIG. 2*c*.

The two bearing halves 61 and 62, when force-fitted together, have their respective semicircular-shaped grooves 61*b* and 62*b* cooperating to form substantially circular-shaped openings for the print wires 19.

The advantageous arrangement of the two-piece plastic bearing enables each of the halves to be formed through a molding operation and thereby eliminates the need for machining of the print wire opening.

FIGS. 6*a*–6*c* show still another preferred one-piece bearing member 70 of the present invention formed of the advantageous materials described hereinabove and have tapering side walls 71 and 72 each provided with slots 71*a* and 72*a* for receiving the inwardly extending projections 11*c* and 11*d* provided within the opening 35 of the front wall of housing member 11. The relative dimensions of projections 11*c* and 11*d* and slots 71*a* and 72*a* is such that the plastic bearing is force-fittingly mounted within opening 35. Alternatively, the projections 11*c* and 11*d* may be omitted and the plastic bearing may be fitted within a slot of the type shown in FIG. 2*c* and be secured therein by a brad of the type shown as brad 50 in FIG. 2*c*.

The bearing is provided with axially aligned elongated openings 73 arranged to guide the print wires 19. The rearward ends of openings 73 communicate with a narrow rectangular shaped slot 74 provided in the rearward portion of plastic bearing 70 to provide sufficient clearance for the natural curvature of the print wires as was described hereinabove.

A pair of tapered slots 75 and 76 are provided in the front face 77 of bearing 70 and narrow slits 78 and 79 aligned with the vertical axis of openings 73 are also provided in front face 77 to provide additional resiliency in the forward end of plastic bearing 70 to significantly reduce side loading imparted upon the plastic bearing by the reciprocating print wires. In addition thereto, each of the print wire openings 73 in the front face 77 communicate with one another by means of narrow slits 79 to further reduce the sidewise loading effects of the print wires upon the plastic bearing.

Figure 7A:
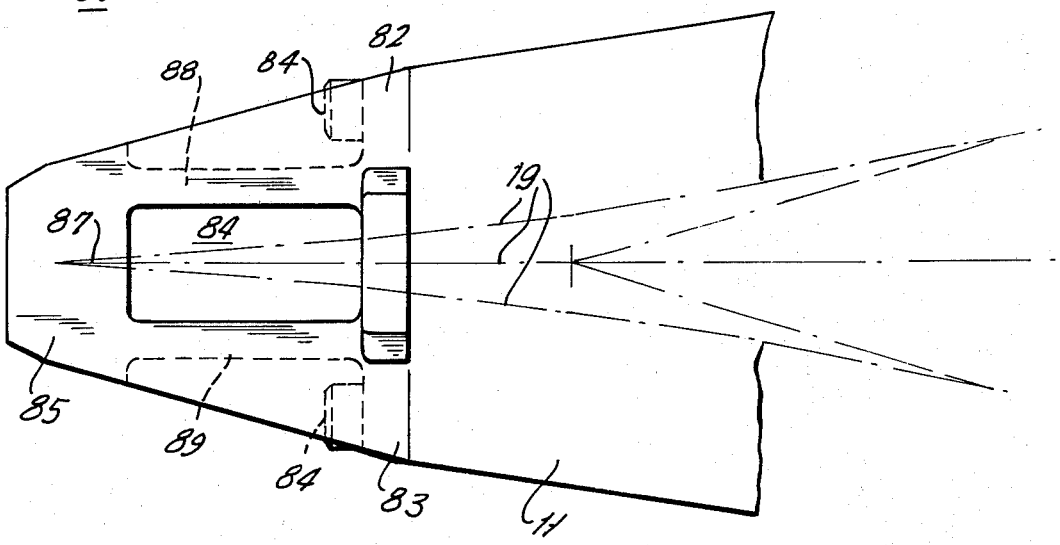
Figure 7B:
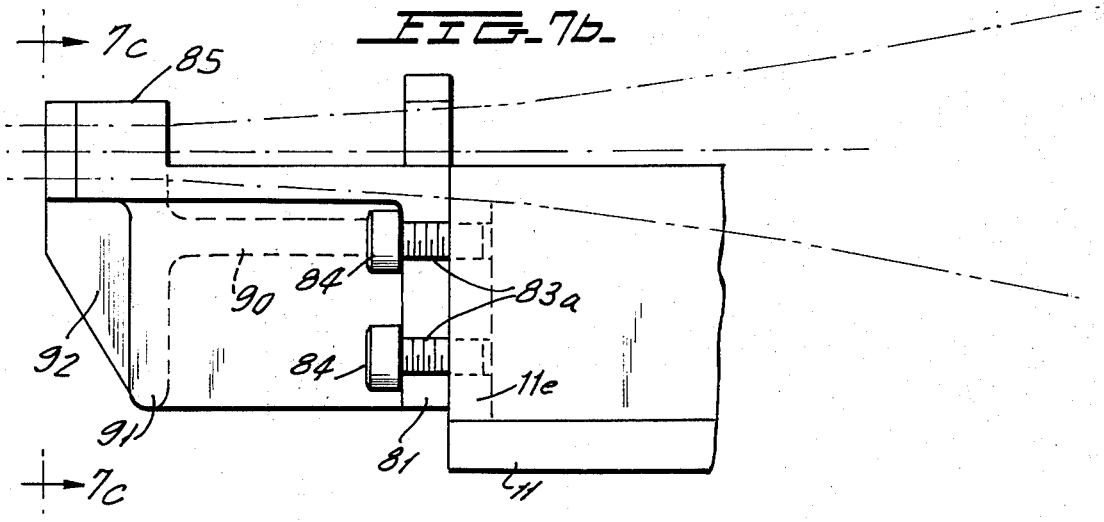
Figure 7C:
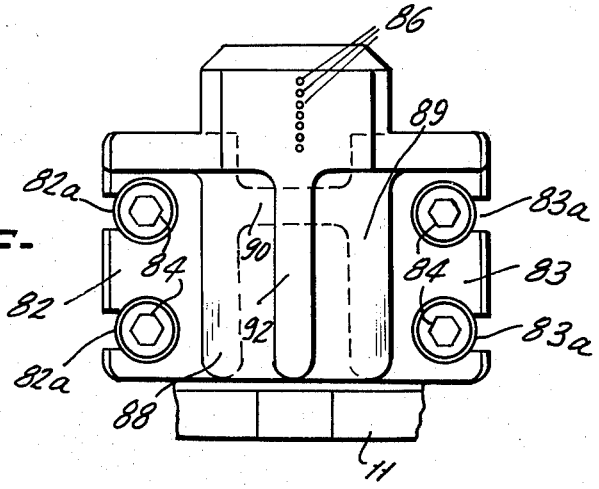

FIGS. 7*a*–7*c* show still another preferred plastic bearing 80 of the present invention having a rear mounting wall 81 provided with outwardly extending flanges 82 and 83 each having slots as shown at 82*a* and 83*a* for receiving fastening members 84 to secure the plastic bearing to the front face ll*e* of the truncated end of a print head housing member 11.

The plastic bearing and combined mount therefore has a hollow interior 84 to permit the passage of print wires 19 also extending through the hollow interior of the print head housing 11.

The forward tip 85 of the bearing member is of increased thickness and is provided with openings 86 which receive print wires 19 and which are tapered as shown at 87 to permit the print wires 19 to follow their natural curvature as they enter into the print wire bearing portion thereof. The combined plastic bearing and mount therefor may, for example, be formed of polycarbonate admixed with the aforementioned materials to provide a self-lubricating bearing.

Extending rearwardly from jewel bearing tip 85 is a pair of vertically aligned arms 88 and 89 which are spanned by a bracing rib 90. The forward ends of arms 88 and 89 are integrally joined to a perpendicularly aligned portion 91 which supports the jewel bearing tip 85 by means of an integrally formed soffit 92. The rearward portions of arms 88 and 89 are integrally joined to the outwardly extending mounting flanges 82 and 83.

The bearing assembly may be removed simply by removing fastening members 84, holding the print wires by a long nose plier and pulling the plastic bearing in the forward direction. Still holding the print wires by means of a long nose pliers, the original plastic bearing or a replacement thereof may then by pressed back into position with the print wires guided through the appropriate openings 86 after which the fastening members 84 are replaced and tightened.

FIG. 8 shows still another preferred embodiment of the present invention in which the plastic bearing 95 is formed through a continuous extrusion process wherein the extruder forms the print wire openings 96 and the top, bottom and left and right-hand side walls 97*a*–97*d* of the bearing respectively. The bearing may be formed in continuous elongated strips and then cut to appropriate length and subsequently machined to form the slots along the side walls 97*c* and 97*d*. Noting, for example, FIG. 8*a*, an elongated continuous extrusion is machined to form the side grooves 98*a* and 98*b*. Thereafter, the elongated extrusion is then cut at regular intervals as shown by dotted lines 99 to form individual jewel bearings at greatly reduced manufacturing cost. As shown in FIG. 8, the print wire guide openings 96 each communicate with the adjacent opening through narrow slots 100. Narrow slots 101 and 102 respectively communicate with the topmost and bottommost openings 96 and, together with slits 100 serve to reduce side loading forces imparted upon the jewel bearing by the reciprocating print wires.

Although there has been described several preferred embodiments of this novel invention, many variations and modifications will now be apparent to those skilled in the art. Therefore, this invention is to be limited, not by the specific disclosure herein, but only by the appending claims.

What is claimed is:

1. A print head assembly comprising:

a hollow housing having a rear mounting wall and side walls tapering toward a forward nose portion;

said rear mounting wall having a plurality of apertures;

a plurality of solenoids each having its forward end secured in one of said apertures and each solenoid having an elongated reciprocating print wire extending from its forward end and through the hollow interior of the housing towards said nose;

said nose portion having an open-ended slot;

the base of said open-ended slot having a pair of spaced openings;

a bearing formed of a compliant self-lubricating plastic and having a plurality of small apertures arranged along an imaginary straight line;

each of said print wires being slidably positioned within one of said small apertures and having its forward free end extending to the front face of said bearing;

the longitudinal axes of said solenoids being aligned so that their print wires gradually merge towards said nose portion; and a U-shaped compliant fastener having a pair of arms depending from a yoke, said fastener embracing the top and side surfaces of said bearing and having each of the free ends of its depending arms force-fitted into an associated one of said openings for releasably securing said bearing in said slot to enable replacement of said bearing.

2. The assembly of claim 1 wherein each of the side walls of said bearing is provided with a groove for positioning and securing one arm of said fastener.

3. The assembly of claim 2 wherein the base of the open ended slot in said nose portion supports said bearing, said slot having a pair of side walls embracing the sides of said bearing;

said side walls each having a groove aligned with an opening in said base whereby the groove in each side wall cooperates with one groove in said bearing to receive an arm of said fastener to thereby accurately position and secure said bearing in said nose.

4. The assembly of claim 1 wherein the arms of the U-shaped fastener are each provided with a compliant continuous flange adjacent the free end thereof, each flange having an outer diameter greater than the largest dimension of each of the spaced openings in said base to snap fitting mount said fastener to said base.

5. A print head assembly comprising:

a hollow housing having a rear mounting wall and side walls tapering toward a forward nose portion;

said rear mounting wall having a plurality of apertures;

a plurality of solenoids each having its forward end secured in one of said apertures and each solenoid having an elongated reciprocating print wire extending from its forward end and through the hollow interior of the housing towards said nose;

said nose portion having an open-ended slot, the base of said open-ended slot having a pair of spaced openings;

a plastic bearing having a plurality of small apertures arranged along an imaginary straight line;

each of said print wires being slidably positioned within one of said small apertures and having its forward free end extending to the front face of said bearing;

said bearing being formed of a compliant selflubricating plastic;

the longitudinal axes of said solenoids being aligned so that their print wires gradually merge toward said nose portion; and a pair of arms, each arm being force-fitted into an associated one of said openings and pressing against a side surface of said bearing for releasably securing said bearing to said housing.

6. The assembly of claim 5 further comprising a one-piece tube support frame comprised of a flat sheet bent into a U-shaped configuration defining a mounting base and first and second upwardly extending guide arms each having a plurality of apertures;

said housing having a floor extending between the side walls of the housing;

said mounting base being secured to the floor of said housing intermediate said rear wall and said nose;

a plurality of hollow curved guide tubes each extending between an associated aperture in said first and second guide arms and each slidably receiving one of said print wires for maintaining the natural curvature of the print wire.

7. The assembly of claim 6 wherein said housing floor is provided with a plurality of short upwardly extending projections;

said mounting base having a plurality of openings each receiving one of said projections which are adapted to be flattened and peened to secure sand tube support frame to said housing.

8. The assembly of claim 5 wherein the front face of said plastic bearing is provided with a pair of slots arranged on opposite sides of said line of apertures for increasing the resiliency of said bearing and thereby reducing the side loading forces imposed upon the bearing by the reciprocating print wires.

9. The assembly of claim 5 wherein side walls of the bearing are tapered inwardly towards the rear face of said bearing to increase the resiliency of the rear portion of the bearing and thereby reduce the impact of side loading forces imparted to the bearing by the reciprocating print wires.

10. The assembly of claim 5 wherein said bearing is comprised of a pair of bearing halves each having a plurality of substantially semi-circular shaped grooves arranged along confronting surfaces;

one of the said confronting surfaces having a plurality of projections extending away from said one confronting surface;

the remaining confronting surface having a plurality of openings each adapted to force-fittingly receive one of said projections when said bearing halves are joined and said confronting surfaces are brought into engagement;

the semi-circular grooves of said confronting surfaces cooperatively defining the apertures which slidably receive said print wires.

11. The assembly of claim 1 wherein the rear portion of said bearing is provided with an elongated slot for receiving all of said print wires;

the inner end of said slot communicating with all of said bearing apertures;

the width of said slot being greater than the diameter of said apertures to preserve the curvature of said print wires and reduce the side loading forces imposed upon said bearing by the reciprocating print wires.

12. The assembly of claim 1 wherein the rear face of said bearing is provided with a recess having chamfered side walls surrounding the apertures in said bearing rear surface to facilitate insertion of the print wires into said bearing apertures.

13. The assembly of claim 5, wherein said bearing is provided with a pair of opposed side walls, an intermediate portion of each side wall having a groove formed into an exterior surface thereof;

said pairs of arms being force-fittingly received within each of said grooves to releasably secure the bearing to the nose.

14. The assembly of claim 5, wherein said bearing is formed of a material comprising thermoplastic nylon.

15. The assembly of claim 14, wherein the bearing material further includes an additive of dry lubricant.

16. The assembly of claim 5, wherein said bearing is formed of a material comprising thermoplastic acetel resin.

17. The assembly of claim 16, wherein the bearing material further includes an additive of dry lubricant.

* * * * *